US007825859B2

(12) United States Patent
Teshima

(10) Patent No.: US 7,825,859 B2
(45) Date of Patent: Nov. 2, 2010

(54) ANTENNA DEVICE OPERABLE IN MULTIPLE FREQUENCY BANDS

(75) Inventor: Masao Teshima, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 583 days.

(21) Appl. No.: 11/973,806

(22) Filed: Oct. 10, 2007

(65) Prior Publication Data

US 2008/0266182 A1 Oct. 30, 2008

(30) Foreign Application Priority Data

Apr. 25, 2007 (JP) ..... 2007-115235

(51) Int. Cl.
*H01Q 1/24* (2006.01)

(52) U.S. Cl. ..... 343/700 MS

(58) Field of Classification Search ..... 343/700 MS, 343/702, 846, 741

See application file for complete search history.

(56) References Cited

U.S. PATENT DOCUMENTS

| | | | | |
|---|---|---|---|---|
| 7,136,022 | B2 | 11/2006 | Sato et al. | |
| 7,345,637 | B2 * | 3/2008 | Mizoguchi et al. | 343/702 |
| 7,535,422 | B2 * | 5/2009 | Liu et al. | 343/702 |
| 7,605,764 | B2 * | 10/2009 | Ishimiya | 343/702 |
| 2003/0210191 | A1 * | 11/2003 | Mohammadian et al. | 343/702 |
| 2008/0074332 | A1 * | 3/2008 | Arronte et al. | 343/702 |
| 2008/0198082 | A1 * | 8/2008 | Castany et al. | 343/770 |
| 2008/0231521 | A1 * | 9/2008 | Pros et al. | 343/702 |

FOREIGN PATENT DOCUMENTS

| | | |
|---|---|---|
| JP | 2002-064324 A | 2/2002 |
| JP | 2005-094501 A | 4/2005 |
| JP | 3775795 | 5/2006 |
| JP | 2006-196994 A | 7/2006 |

* cited by examiner

*Primary Examiner*—Huedung Mancuso
(74) *Attorney, Agent, or Firm*—Holtz, Holtz, Goodman & Chick, PC

(57) ABSTRACT

An antenna device usable in a radio apparatus having a printed board includes a ground conductor provided in the printed board, a fed partial element, a first branch element and a second branch element. The fed partial element is shaped as an area including a feed portion near an end of a first side of the area facing a side of the ground conductor, and a first branch portion and a second branch portion each near a portion of a fringe of the area other than the first side. The fed partial element may be fed at the feed portion. The first branch element branches off from the first branch portion and is folded back in a direction approaching the feed portion. The second branch element branches off from the second branch portion and is shaped in a direction close to the direction of the first branch element.

20 Claims, 7 Drawing Sheets

ANTENNA DEVICE OPERABLE IN MULTIPLE FREQUENCY BANDS

CROSS REFERENCE TO RELATED APPLICATIONS

This application is based upon and claims the benefit of priority from the prior Japanese Patent Application No. 2007-115235 filed on Apr. 25, 2007;

the entire contents of which are incorporated herein by reference.

BACKGROUND OF THE INVENTION

1. Field of the Invention

The present invention relates to an antenna device operable in multiple frequency bands, and in particular to an antenna device which may be built into a radio apparatus.

2. Description of the Related Art

There is a trend that mobile phones or personal computers (PCs) with radio capability have multiple purposes and multiple functions. The above trend requires an antenna device which may be operable in multiple frequency bands or in a broad frequency range.

For the above requirement, e.g., the applicant applied for and obtained a patent on an invention of a built-in antenna of a radio apparatus which is operable in multiple frequency bands having impedance that may be smoothly matched, as disclosed in Japanese Patent Publication (Toroku), No. 3775795.

In addition, a conventional antenna device configured to be operable in multiple frequency bands or in a broad frequency range is disclosed in Japanese Patent Publication of Unexamined Applications (Kokai), No. 2002-64324.

More specifically, as shown in FIG. 10 and in paragraphs 0096-0102, the antenna device disclosed in JP 2002-64324 includes a planar-shaped microstrip antenna 42 and a monopole antenna 1. The microstrip antenna 42 is arranged parallel to a ground plane 6. An end of the microstrip antenna 42 is connected to an end of the monopole antenna 1. The antenna device disclosed in JP 2002-64324 has a single resonant frequency, and the monopole antenna 1 is about half as long as a wavelength of the resonant frequency.

The planar-shaped microstrip antenna 42 has a length "a" and a width "b". The length "a" is about half as long as the wavelength of the resonant frequency. It is described in JP 2002-64324 that a greater value of the width "b" produces a greater value of an antenna's electrical volume, and contributes to a broader frequency range thereby.

Another conventional antenna device is disclosed in Japanese Patent Publication of Unexamined Applications (Kokai), No. 2005-94501. More specifically, as shown in FIG. 5 and in paragraphs 0021, 0022 and 0031-0033, the antenna device disclosed in JP 2005-94501 is a planar multiple-layered antenna including a rectangular conductive pattern 43 and a U-shaped conductive pattern 45. The rectangular conductive pattern 43 and a ground board conductor 49 are located on a same plane.

It is described in JP 2005-94501 that the planar multiple-layered antenna is resonant at multiple frequencies, having a first resonant frequency f1 and a second resonant frequency f2, where f1<f2. At the first resonant frequency f1, antenna current resonance occurs on the U-shaped conductive pattern 45 as a whole. At the second resonant frequency f2, resonance occurs along an inner portion of the U-shaped conductive pattern.

The above built-in antenna of a radio apparatus disclosed in JP 3775795 includes a first antenna element being folded and having a grounded end which may be resonant at a relatively lower frequency, and a second antenna element having an open end which may be resonant at a relatively higher frequency. The antenna disclosed in JP 3775795 is configured to allow impedance of the second antenna element to be matched by adjusting a position where a forward path and a backward path, both of the folded first antenna element, are short-circuited.

As the resonant frequency of the second antenna element becomes higher, the above short-circuit position shall be located closer to a feeding point for impedance matching, making the impedance more inductive at the resonant frequency of the first antenna element. Thus, it may be difficult in some cases to determine each of the resonant frequencies independently.

Meanwhile, nothing is disclosed in JP 2002-64324 with respect to multiple-frequency resonance of the antenna device. As the antenna device disclosed in JP 2005-94501 utilizes the resonance on the U-shape as a whole and the resonance along the inner portion of the U-shape, it may be difficult to separate the resonant frequencies beyond a certain extent or to determine each of the resonant frequencies independently.

SUMMARY OF THE INVENTION

Accordingly, an object of the present invention is to provide an antenna device of multiple-frequency resonance configured to give a value to each of resonant frequencies as independently as possible.

To achieve the above advantage, according to one aspect of the present invention, an antenna device usable in a radio apparatus having a printed circuit board includes a ground conductor provided in the printed circuit board, a fed partial element, a first branch element and a second branch element.

The fed partial element is shaped as an area including a feed portion near an end of a first side of the area facing a side of the ground conductor. The fed partial element includes a first branch portion and a second branch portion each near a portion of a fringe of the area other than the first side. The fed partial element is configured to be fed at the feed portion.

The first branch element branches off from the first branch portion and reaches a first open end. The first branch element is shaped in a manner to be folded back in a direction approaching the feed portion.

The second branch element branches off from the second branch portion and reaches a second open end. The second branch element is shaped in a direction close to the direction of the first branch element.

DETAILED DESCRIPTION OF THE INVENTION

Figure 1:
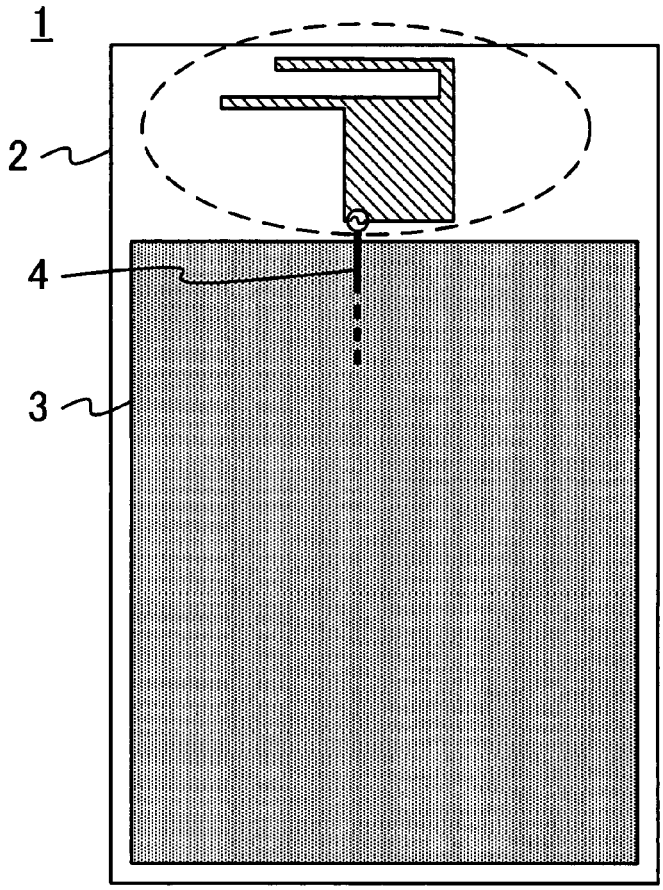
FIG. 1 is a plan view of an antenna device of a first embodiment of the present invention.

Hereinafter, embodiments of the present invention will be described in detail. In following descriptions, terms like upper, lower, left, right, horizontal or vertical used while referring to a drawing shall be interpreted on a page of the drawing unless otherwise noted. Besides, a same reference numeral given in no less than two drawings shall represent a same member or a same portion.

A first embodiment of the present invention will be described with reference to FIGS. 1-12B. FIG. 1 is a plan view of an antenna device 1 of the first embodiment. The antenna device 1 may be used for a radio apparatus (not shown) usable at each of three frequencies (named F1, F2 and F3), where a high-low relationship among the frequencies F1, F2 and F3 will be explained later.

The above radio apparatus includes a circuit board 2. The antenna device 1 includes a ground conductor 3 provided in the circuit board 2. The antenna device 1 includes an antenna element located close to the ground conductor 3. The antenna element has a plurality of partial elements which will be explained later. The antenna element is connected to a radio circuit of the radio apparatus (not shown) by a feed line 4 located on the ground conductor 3.

The antenna element included in the antenna device 1 may be formed by conductive patterns of the circuit board 2, e.g., as indicated (surrounded) by a dashed ellipse shown in FIG. 1. The antenna element may be formed by other than the conductive patterns of the circuit board 2 as long as located close to the ground conductor 3. The feed line 4 may be formed by, e.g., a coaxial cable, another kind of cabling material or a coplanar line, i.e., a conductive pattern of the circuit board 2.

Figure 2:
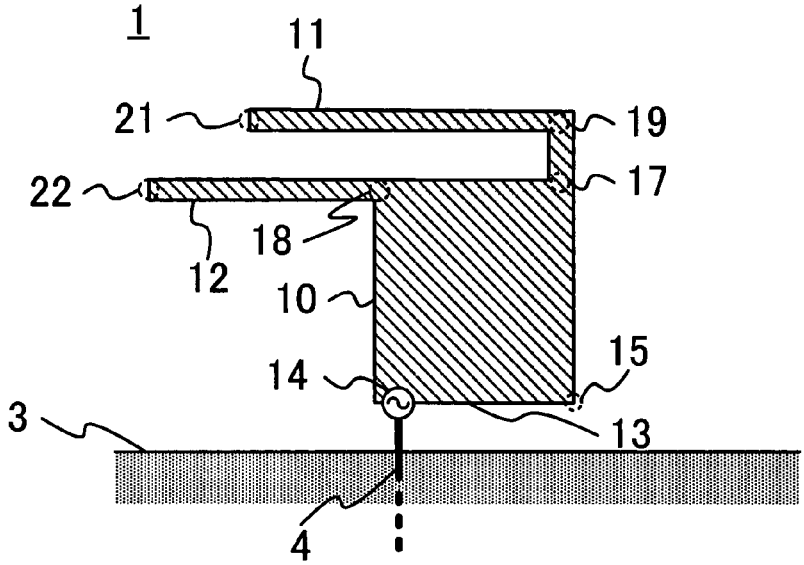
FIG. 2 is a plan view of a main portion of the antenna device of the first embodiment to show a configuration of the main portion in detail.

The antenna device 1 has a main portion which will be explained with reference to FIG. 2 in detail. FIG. 2 is a plan view to show a configuration and a shape of the main portion of the antenna device 1.

The antenna element of the antenna device 1 has a fed partial element 10, a first branch element 11 and a second branch element 12. The fed partial element 10 includes a portion connected to the feed line 4. Each of the first branch element 11 and the second branch element 12 branches off from the fed partial element 10 and reaches an open end.

The fed partial element 10 is surrounded by a fringe to form an area, and the fringe includes a lower side 13 facing an upper side of the ground conductor 3. The fed partial element 10 includes, close to the lower side 13, a feed portion 14 to which the feed line 4 is connected. One of two ends of the lower side 13 which is farther to the feed portion 14 is named a far end 15. The fed partial element 10 includes a first branch portion 17 and a second branch portion 18 each near a portion of the fringe other than the lower side 13.

The first branch element 11 branches off from the fed partial element 10 at the first branch portion 17. The first branch element 11 is folded at a fold portion 19 in a leftward direction approaching the feed portion 14. The first branch element 11 may be almost parallel to the upper side of the ground conductor 3. The first branch element 11 reaches a first open end 21.

The second branch element 12 branches off from the fed partial element 10 at the second branch portion 18 in a direction close to the direction of the first branch element 11. The second branch element 12 may be almost parallel to the upper side of the ground conductor 3 as going away from the far end 15. The second branch element 12 reaches a second open end 22.

If the antenna device 1 is fed at the feed portion 14, three paths of radio frequency (RF) currents are formed as explained with reference to FIGS. 3A-3C. Each of FIGS. 3A-3C shows the shape of the antenna element of the antenna device 1, but omits the ground conductor 3.

Figure 3A:
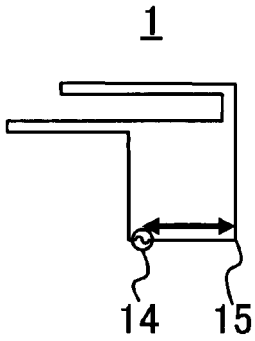
FIGS. 3A, 3B and 3C are plan views of an antenna element of the antenna device of the first embodiment to show RF current paths corresponding to resonant frequencies F1, F2 and F3, respectively.

FIG. 3A is a plan view of the antenna element of the antenna device 1 to show a first RF current path which is formed if the antenna device 1 is fed at the feed portion 14. The first RF current path is from the feed portion 14 to the far end 15 as shown by a bidirectional arrow in FIG. 4A. If the first RF current path is given a length of about one-quarter of a wavelength of the frequency F1, the antenna device 1 may be made resonant at the frequency F1.

Figure 3B:
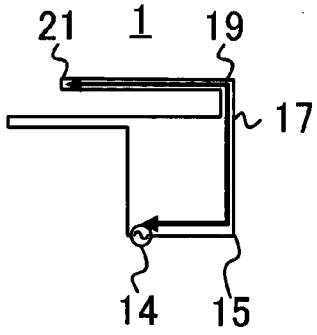

FIG. 3B is a plan view of the antenna element of the antenna device 1 to show a second RF current path which is formed if the antenna device 1 is fed at the feed portion 14. The second RF current path is from the feed portion 14, via the far end 15, the first branch portion 17 and the fold portion 19, and to the first open end 21 as shown by a bidirectional arrow in FIG. 4B. If the second RF current path is given a length of about one-quarter of a wavelength of the frequency F2, the antenna device 1 may be made resonant at the frequency F2.

Figure 3C:
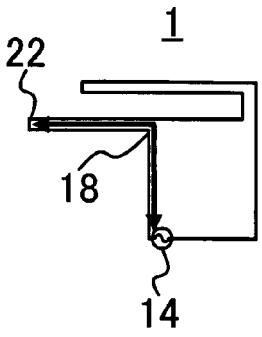

FIG. 3C is a plan view of the antenna element of the antenna device 1 to show a third RF current path which is formed if the antenna device 1 is fed at the feed portion 14. The third RF current path is from the feed portion 14, via the second branch portion 18 and to the second open end 22, as shown by a bidirectional arrow in FIG. 3C. If the third RF current path is given a length of about one-quarter of a wavelength of the frequency F3, the antenna device 1 may be made resonant at the frequency F3.

The third RF current path is, more exactly, from the feed portion 14, via a left end of the lower side 13 and the second branch portion 18, and to the second open end 22. As the feed portion 14 is located close to the left end of the lower side 13, the third RF current path may be described above in a simplified manner.

The antenna device 1 has a feature and an effect produced by the configuration and the shape shown in FIG. 2, which will be explained comparing to antenna device models of different configurations and shapes (hereinafter simply called the models) with reference to FIG. 4A through FIG. 10.

Figure 4A:
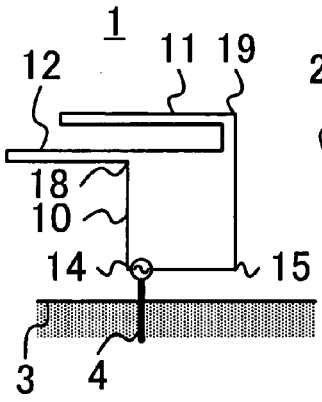
FIG. 4A is a plan view of the antenna device of the first embodiment.
Figure 4B:
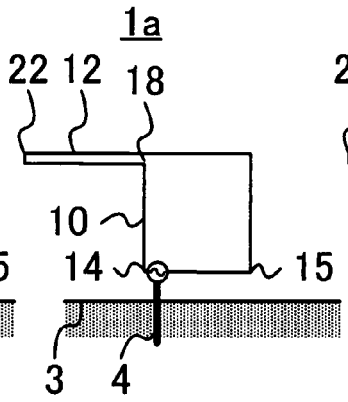
FIGS. 4B and 4C are plan views of a first one and a second one, respectively, of antenna device models of different configurations or shapes to be compared with the antenna device of the first embodiment.
Figure 4C:
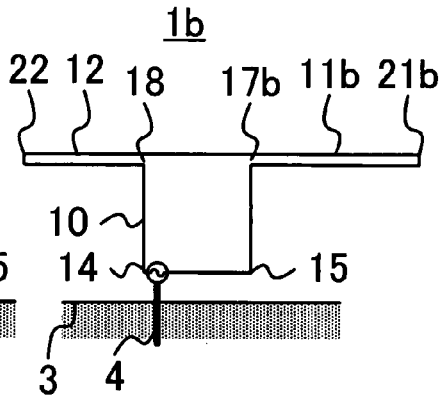

FIGS. 4A-4C are plan views to show configurations and shapes of the antenna device 1 and two of the above models to be compared to each other. FIG. 4A is a plan view of the antenna device 1 to show the configuration and the shape which have been explained with reference to FIG. 2.

FIG. 4B is a plan view of an antenna device 1*a*, a first one of the models, to show a configuration and a shape of the antenna device 1*a* to be compared with the antenna device 1. The antenna device 1*a* is formed by removing the first branch element 11 from the antenna device 1, and each of other portions of the antenna device 1*a* is given a same reference numeral of the corresponding one of the antenna device 1.

FIG. 4C is a plan view of an antenna device 1*b*, a second one of the models, to show a configuration and a shape of the antenna device 1*b* to be compared with the antenna device 1. The antenna device 1*b* is formed by adding to the antenna device 1*a* a first branch element 11*b* which branches off rightwards from a first branch portion 17*b* to a first open end 21*b*.

The first branch element 11*b* of the antenna device 1*b* branches off in a direction different from the direction in which the first branch element 11 of the antenna device 1 branches off. Each of portions of the antenna device 1*b* other than the first branch element 11*b* is a same as the corresponding one of the antenna device 1 given the same reference numeral.

Figure 5:
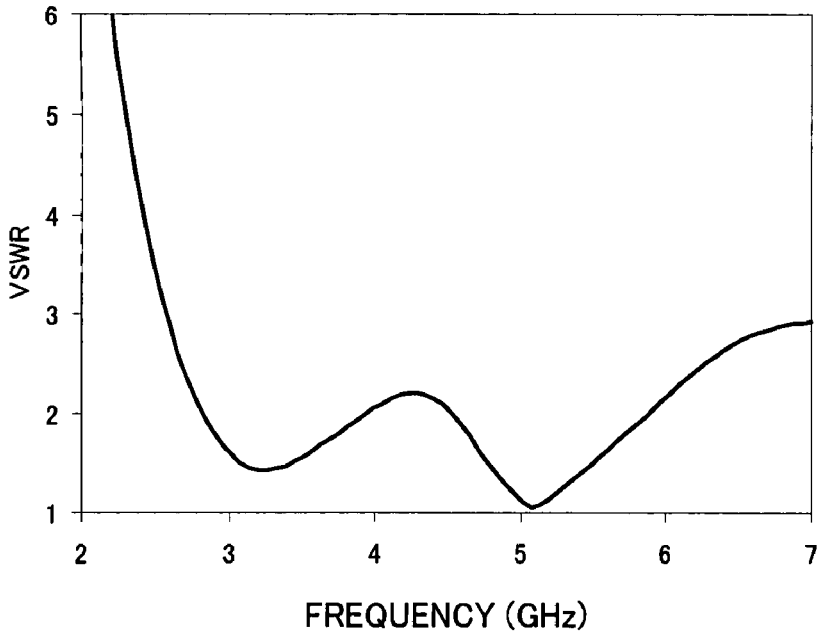
FIG. 5 is a graph of a resonance characteristic of the antenna device shown in FIG. 4B.

FIG. 5 is a graph of a resonance characteristic of the antenna device 1*a* shown in FIG. 4B estimated by a simulation under following numerical conditions. The fed partial element 10 has a horizontal width of ten millimeters (10 mm) and a vertical height of 10 mm. The feed portion 14 is located at a left end of the horizontal width of the fed partial element 10.

The second branch element 12 has a length of 14 mm from the second branch portion 18 to the second open end 22. The second branch element 12 is parallel to the upper side of the ground conductor 3, and has a width of 1 mm. The lower side 13 of the fed partial element 10 is parallel to and 1 mm away from the upper side of the ground conductor 3.

The graph of FIG. 5 has a horizontal axis representing frequencies in gigahertz (GHz) and a vertical axis representing a voltage standing wave ratio of the antenna device 1*a* at the feed portion 14. As shown in FIG. 5, the antenna device 1*a* has two resonant frequencies.

Upper one of the resonant frequencies (around 5 GHz) is determined by the path length from the feed portion 14 to the far end 15. Lower one of the resonant frequencies (around 3 GHz) is determined by the path length from the feed portion 14, via the second branch portion 18 and to the second open end 22.

Figure 6:
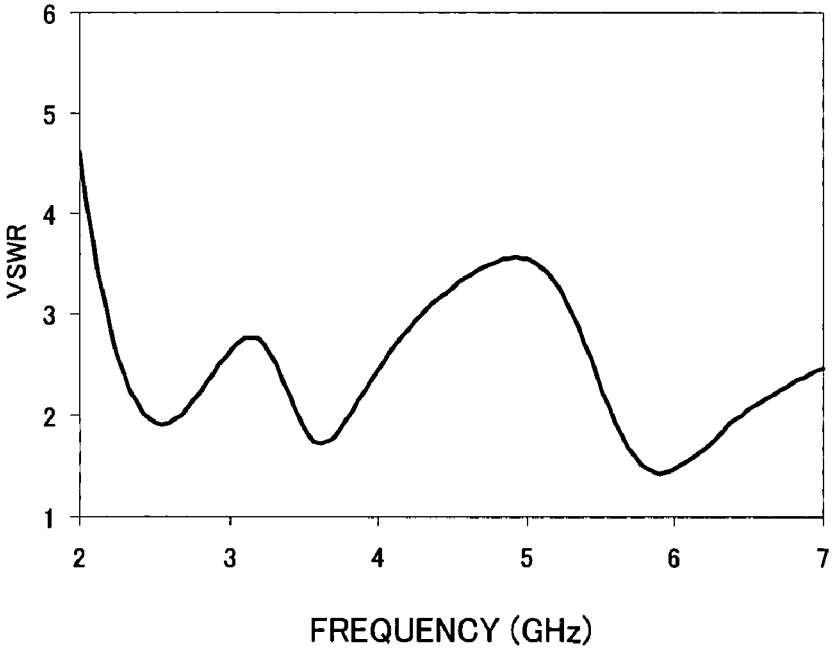
FIG. 6 is a graph of a resonance characteristic of the antenna device shown in FIG. 4C.

FIG. 6 is a graph of a resonance characteristic of the antenna device 1*b* shown in FIG. 4C estimated by a simulation under the same conditions as of FIG. 5, plus conditions that the first branch element 11*b* has a length of 20 mm from the first branch portion 17*b* to the first open end 21*b* and a width of 1 mm, and that the first branch element 11*b* is parallel to the upper side of the ground conductor 3.

The graph of FIG. 6 has a horizontal axis representing frequencies in GHz and a vertical axis representing a voltage standing wave ratio of the antenna device 1*b* at the feed portion 14. As shown in FIG. 6, the antenna device 1*b* has three resonant frequencies.

Highest one of the resonant frequencies (around 6 GHz) is determined by the path length from the feed portion 14 to the far end 15. Second highest one of the resonant frequencies (around 3.6 GHz) is determined by the path length from the feed portion 14, via the second branch portion 18 and to the second open end 22. Lowest one of the resonant frequencies (around 2.5 GHz) is determined by the path length from the feed portion 14, via the far end 15 and the first branch portion 17*b* and to the first open end 21*b*.

As shown by comparison between FIG. 5 and FIG. 6, the antenna device 1*b* has more resonant frequencies than the antenna device 1*a* has, and is advantageous to multiple-frequency resonance thereby. The antenna device 1*b* has a characteristic, however, that not only the lowest resonant frequency but also the highest and the second highest resonant frequencies vary depending upon the length of the first branch element 11*b*.

The above characteristic of the antenna device 1*b* will be explained with reference to FIG. 7, a graph of resonance characteristics of the antenna device 1*b* estimated by a simulation given the length of the first branch element 11*b* as a variable parameter. The simulation has been done under the same conditions as of FIG. 6, plus a condition that the parameter (the length of the first branch element 11*b*) values one of 20, 24 and 28 mm.

Figure 7:
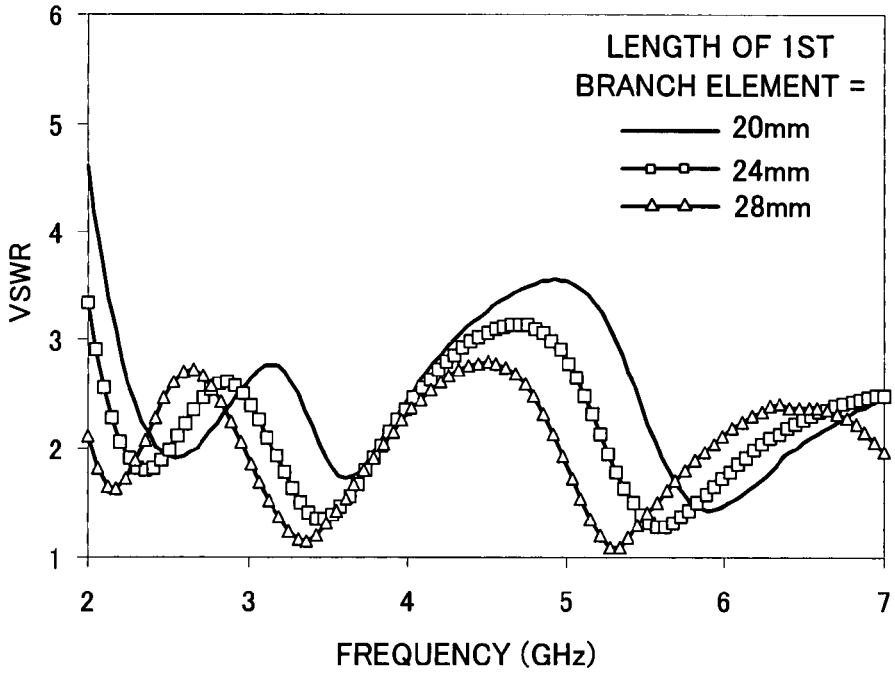
FIG. 7 is a graph of a resonance characteristic of the antenna device shown in FIG. 4C, given a length of a first branch element as a variable parameter.

The graph of FIG. 7 has a horizontal axis representing frequencies in GHz and a vertical axis representing a voltage standing wave ratio of the antenna device 1*b* at the feed portion 14. FIG. 7 shows three characteristic curves each of which corresponds to one of the above values of the parameter (the length of the first branch element 11*b*).

As the parameter changes among the above values, the lowest resonant frequency which is directly affected by and is most sensitive to the above change of the parameter varies approximately from 2.1 to 2.7 GHz. Meanwhile, though, the second highest and the highest resonant frequencies also vary approximately from 3.3 to 3.7 GHz and from 5.2 to 5.9 GHz, respectively, as shown in FIG. 7. Thus, it is difficult for the antenna device 1*b* to determine each of the resonant frequencies independently.

Figure 8:
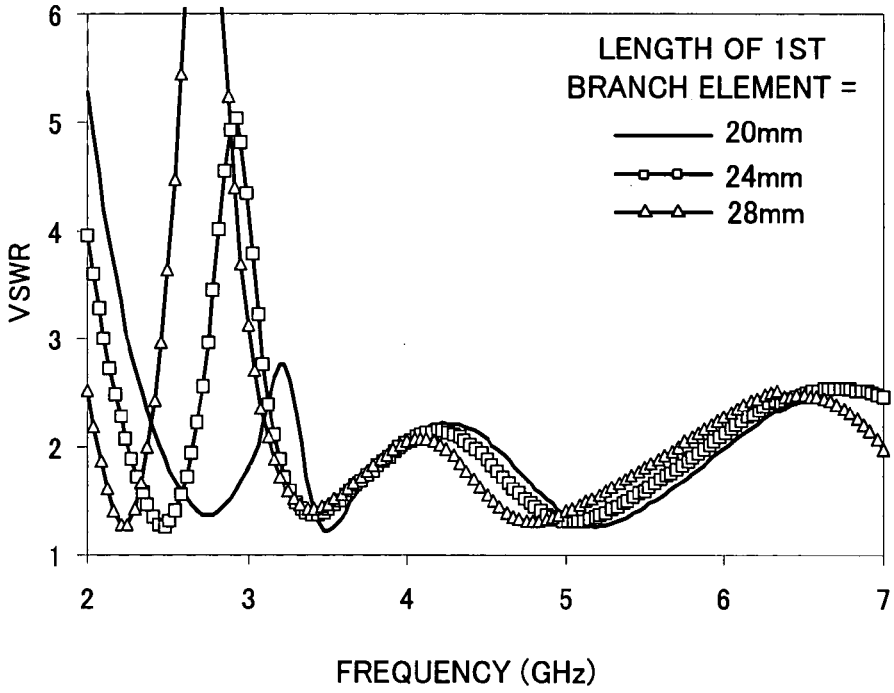
FIG. 8 is a graph of a resonance characteristic of the antenna device shown in FIG. 4A given a length of a first branch element as a variable parameter.

It will be explained with reference to FIG. 8 how independently each of the resonant frequencies of the antenna device 1 shown in FIG. 4A may be determined. FIG. 8 is a graph of resonance characteristics of the antenna device 1 estimated by a simulation given the length of the first branch element 11 as a variable parameter.

The simulation has been done under the same conditions as applied to the simulation of FIG. 6 for the antenna device 1*b*, plus conditions that portions of the first branch element 11 and the second branch element 12 parallel to each other are 2 mm away, and that the parameter (the length of the first branch element 11) values one of 20, 24 and 28 mm.

The graph of FIG. 8 has a horizontal axis representing frequencies in GHz and a vertical axis representing a voltage standing wave ratio of the antenna device 1 at the feed portion 14. FIG. 8 shows three characteristic curves each of which corresponds to one of the above values of the parameter (the length of the first branch element 11).

As the parameter changes among the above values, the lowest resonant frequency which is directly affected by and is most sensitive to the above change of the parameter varies approximately from 2.1 to 2.8 GHz. Meanwhile, the second highest and the highest resonant frequency vary approximately from 3.3 to 3.4 GHz and from 4.8 to 5.1 GHz, respectively, which are smaller variations relative to the corresponding ones shown in FIG. 7.

There is a difference between the antenna device 1*b* and the antenna device 1 in how independently each of the resonant frequencies may be determined, and the difference will be explained in a qualitative manner. In FIG. 4C, an RF current path corresponding to the lowest resonant frequency (called the lowest frequency path) of the antenna device 1*b* is formed from the feed portion 14, via the far end 15 and the first branch portion 17*b*, and to the first open end 21*b*.

If the lowest frequency path of the antenna device 1*b* is around an odd-number (no less than three) times as long as one-quarter wavelength (no less than (¾)λ, where λ represents a wavelength) of the highest resonant frequency or of the second highest resonant frequency, an RF current of around the highest resonant frequency or the second highest resonant frequency may be distributed along the lowest frequency path of the antenna device 1*b*.

As including a portion from the feed portion 14 to the far end 15 and a portion from the first branch portion 17*b* to the first open end 21*b* both of which are directed almost in a same direction, the lowest frequency path which works as a transmission line goes through a less significant variation of conditions. Thus, the lowest frequency path of the antenna device 1*b* may somewhat easily cause the above RF current distribution of no less than ¾λ.

In FIG. 4A, an RF current path corresponding to the lowest resonant frequency (called the lowest frequency path) of the antenna device 1 is formed from the feed portion 14, via the far end 15, the first branch portion 17 and the fold portion 19, and to the first open end 21. The lowest frequency path of the antenna device 1 starts from the feed portion 14, reaches the far end 15, and is folded in the direction approaching the feed portion 14 from the fold portion 19 to the first open end 21.

If the lowest frequency path of the antenna device 1 is around an odd-number (no less than three) times as long as one-quarter wavelength (no less than (¾)λ) of the highest resonant frequency or of the second highest resonant frequency, an RF current of around the highest resonant frequency or the second highest resonant frequency may be distributed along the lowest frequency path of the antenna device 1.

The lowest frequency path of the antenna device 1 includes, however, a starting portion from the feed portion 14 to the far end 15 and an ending portion from the first branch portion 17 (via the fold portion 19) to the first open end 21 which is directed opposite to the starting portion after being folded. Thus, the lowest frequency path of the antenna device 1 which works as a transmission line goes through a rather significant variation of conditions, and may somewhat hardly cause the above RF current distribution of no less than (¾)λ.

As described just above, an RF current distribution of no less than (¾)λ of one of the highest and the second highest resonant frequencies (F1 or F3) along the lowest frequency path of the antenna device 1 is of a smaller ratio relative to the corresponding one of the antenna device 1*b*. The highest and the second highest resonant frequencies of the antenna device 1 depend less upon the length of the lowest frequency path thereby.

Figure 9A:
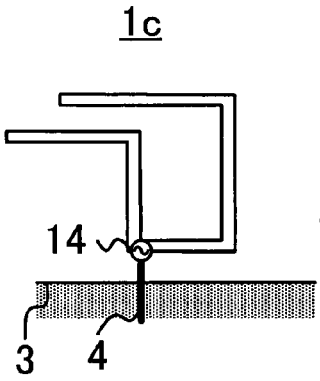
FIG. 9A is a plan view of a third one of the antenna device models to be compared with the antenna device of the first embodiment.

It will be explained with reference to FIGS. 9A, 9B and 10 how independently each of resonant frequencies of the antenna device 1 may be determined comparing to an antenna device 1*c*, a third one of the models of different configurations or shapes. FIG. 9A is a plan view of the antenna device 1*c* to be compared with the antenna device 1. As shown in FIG. 9A, the antenna device 1*c* is shaped to be folded four times, and each of other portions is given a same reference numeral as shown in FIGS. 4A-4C for convenience.

Figure 9B:
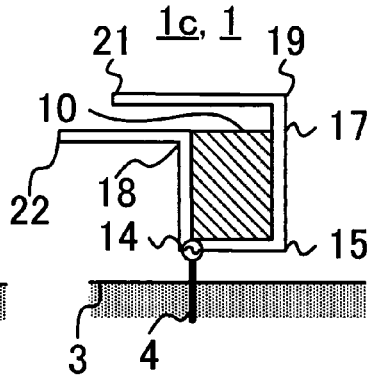
FIG. 9B is a plan view of the third one of the models overlaid on the antenna device of the first embodiment.

FIG. 9B is a plan view of the antenna device 1*c* overlaid on the antenna device 1. In FIG. 9B, portions of the antenna device 1 not hidden by the antenna device 1*c* are the ground conductor 3 and a hatched portion of the fed partial element 10. FIG. 9B also shows a reference numeral of each of the portions of the antenna device 1.

As shown in FIG. 9B, the antenna device 1*c* is formed along the two RF current paths of the antenna device 1. The one of the RF current paths is from the feed portion 14, via the far end 15, the first branch portion 17 and the fold portion 19, and to the first open end 21. The other of the RF current paths is from the feed portion 14, via the second branch portion 18 and to the second open end 22.

Figure 10:
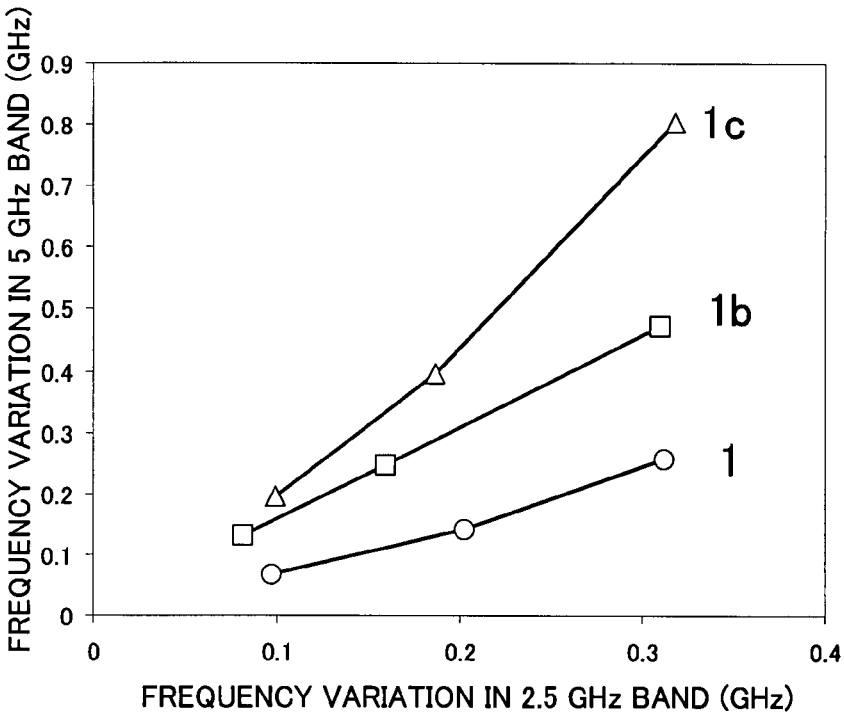
FIG. 10 is a graph of plots representing frequency variations in a 2.5 GHz band and in a 5 GHz band of the antenna device of the first embodiment, and the second and third ones of the models shown in FIG. 4C and in FIG. 9A, respectively.

FIG. 10 is a graph of plots representing the frequency variations in a 2.5 GHz band and in a 5 GHz band of the antenna devices 1, 1*b* and 1*c* estimated by simulations to show how independently the antenna devices 1, 1*b* and 1*c* may determine each of the resonant frequencies.

In the above simulations, same conditions as applied to the simulation of FIG. 8 are provided for the antenna device 1, given the length of the first branch element 11 as a variable parameter. For the antenna device 1*b*, same conditions as applied to the simulation of FIG. 7 are provided given the length of the first branch element 11*b* as a variable parameter. For the antenna device 1*c*, the same conditions as of the antenna device 1 are provided.

The graph of FIG. 10 has a horizontal axis representing a frequency variation in the 2.5 GHz band of the lowest resonant frequency of the antenna devices 1, 1*b* and 1*c*, while the parameter changes among 20, 24 and 28 mm. The graph of FIG. 10 has a vertical axis representing a frequency variation in the 5 GHz band of the highest resonant frequency which corresponds to the frequency variation in the 2.5 GHz band. Thus, a smaller value on the vertical axis against a greater value on the horizontal axis implies that the resonant frequencies may be determined more independently.

As shown in FIG. 10, relatively, the antenna device 1 may determine the resonant frequencies most independently. The antenna device 1*b* may determine the resonant frequencies less independently than the antenna device 1. The antenna device 1*c* may determine the resonant frequencies less independently than the antenna device 1*b*.

Why the antenna device 1*c* shows lowest independence in determining the resonant frequencies is probably for a following reason. As the antenna device 1*c* has an RF current path of an almost uniform width from the feed portion 14 to the first open end 21, RF currents of highest and the second highest frequencies may be distributed along a whole length of the RF current path. The highest and the second highest frequencies may depend more on a length of the RF current path thereby.

For the simulations described above, the lower side 13 of the fed partial element 10 and the upper side of the ground conductor 3 of the printed board 2 have been assumed to be parallel to each other with a distance of 1 mm. It may be expected that the antenna device 1 degrade performance as the above distance grows, as explained with reference to FIG. 11.

Figure 11:
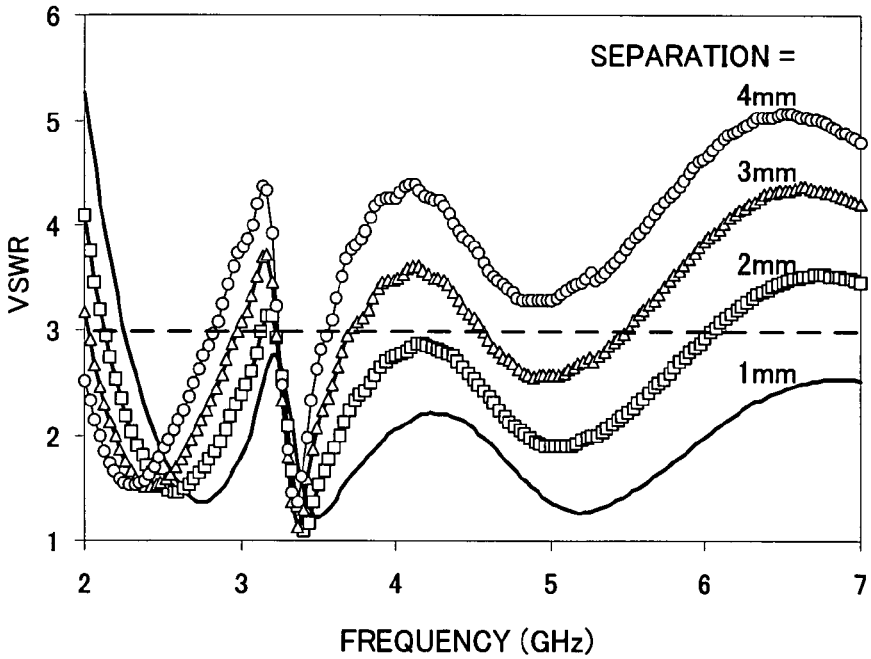
FIG. 11 is a graph of a resonance characteristic of the antenna device of the first embodiment, given a distance between an antenna element and a ground conductor both included in the antenna device as a variable parameter.

FIG. 11 is a graph of resonance characteristics of the antenna device 1 estimated by a simulation like FIG. 8, given the above distance as a variable parameter. The simulation has been done under the same conditions as of FIG. 8, where the distance between the lower side 13 of the fed partial element 10 and the upper side of the ground conductor 3 is given as a variable parameter from 1 to 4 mm.

In the 5 GHz band shown in FIG. 11, the VSWR values no greater than three (shown by a dashed horizontal line) if the above parameter values no greater than 3 mm. The above value of the parameter (3 mm) may generally correspond to three tenths of the length from the feed portion 14 to the far end 15 (10 mm), which may be thought of as a benchmark. The lower side 13 of the fed partial element 10 and the upper side of the ground conductor 3 may not be strictly parallel to each other as long as a distance in between is no greater than the above benchmark.

As described above, the highest resonant frequency of the antenna device 1 is F1 (determined by the length from the feed portion 14 to the far end 15), the lowest resonant frequency is F2 (determined by the length from the feed portion 14, via the far end 15, the first branch portion 17 and the fold portion 19, and to the first open end 21), and the second highest resonant frequency is F3 (determined by the length from the feed portion 14, via the second branch portion 18 and to the second open end 22).

Among F1, F2 and F3, a high-low relationship between F1 and F2 may not be changed due to a long-short relationship between the corresponding path lengths. A high-low relationship between F3 and F2 may be changed by a long-short relationship between the first branch element 11 and the second branch element 12. Supposing the shape of the antenna device 1 shown in FIG. 1 or FIG. 2, however, as the second branch element 12 becomes longer, downsizing of the antenna device 1 becomes more difficult due to a wider horizontal width of the antenna device 1. Thus, it is preferable to determine the length of the second branch element 12 in such a way that a relationship F2<F3<F1 is satisfied.

Figure 12A:
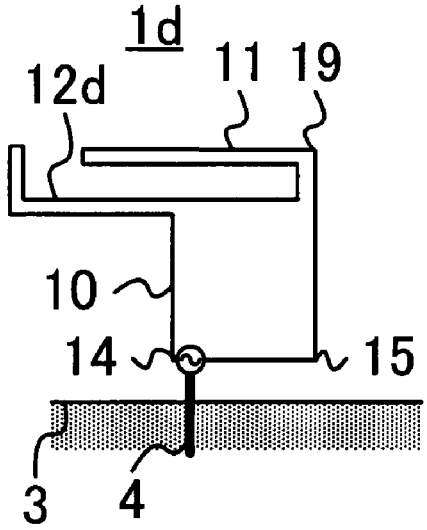
FIGS. 12A and 12B are plan views of a first modification and a second modification, respectively, of the antenna device of the first embodiment.

The antenna device 1 may be modified as explained with reference to FIGS. 12A and 12B. FIG. 12A is a plan view of an antenna device 1*d*, a first modification of the antenna device 1, to show a configuration and a shape of the antenna device 1*d*. The antenna device 1*d* includes a second branch element 12*d* instead of the second branch element 12 of the antenna device 1. Each of other portions of the antenna device 1*d* is a same as the corresponding one of the antenna device 1.

The second branch element 12*d* is shaped in such a way that a portion including an open end of the second branch element 12*d* is folded upwards. Folding the end portion of the second branch element 12*d* as shown in FIG. 12A may keep the horizontal width of the antenna device 1*d* from growing and may contribute to downsizing of the antenna device 1*d*.

Figure 12B:
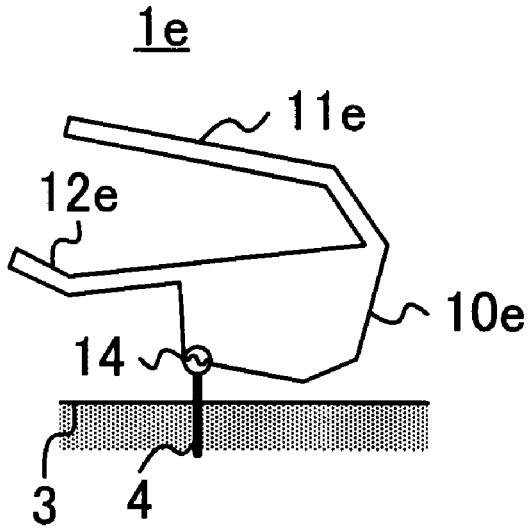

FIG. 12B is a plan view of an antenna device 1*e*, a second modification of the antenna device 1, to show a configuration and a shape of the antenna device 1*e*. The antenna device 1*e* includes a fed partial element 10*e*, a first branch element 11*e* and a second branch element 12*e*. The antenna device 1*e* has a shape shown in FIG. 12B to be compared with the shape of the antenna device 1 shown in FIG. 4A.

As shown by the above comparison, the antenna device 1*e* is different from the antenna device 1 in that each of a portion corresponding to the lower side 13, the first branch element 11 and the second branch element 12 is not parallel to the upper side of the ground conductor 3. The antenna device 1*e* may produce an effect similar to the effect of the antenna device 1 to greater or lesser degrees, however, if following conditions are satisfied.

A first one of the conditions is that a distance between the portion corresponding to the lower side 13 and the ground conductor 3 is no greater than three tenths of a width of the portion corresponding to lower side 13. A second one of the conditions is that an RF current path is formed along a fringe from the feed portion 14 to an open end of the first branch element 11*e* in a manner to be folded back. A third one of the conditions is that the second branch element 12*e* is formed in a direction going away from a portion corresponding to the far end 15.

In the above simulations of the first embodiment, each of the widths of the first branch element 11 and the second branch element 12 has been assumed to be 1 mm. An effect of changing the widths of the first and the second branch elements 11 and 12 has been studied by the inventor of the present invention. In a case where the first branch element 11 shown in FIG. 4A has a width of, e.g., 5 or 10 mm based on the same conditions as of FIG. 8, the lowest resonant frequency (F2) has been observed to decrease. The above decrease of F2 is due to the RF current path length extended as the width of the first branch element 11 has been broadened.

In a case where the second branch element 12 has a width of 5 or 10 mm, no resonant frequencies have been observed to change for a reason that the RF current path length determining the resonant frequency F3 does not depend upon the width of the second branch element 12. In the latter case, impedance of the antenna device 1 decreases as the distance between the second branch element 12 and the ground conductor 3 decreases.

As described above, the resonant frequency and the impedance of the antenna device 1 may vary depending upon the widths of the first branch element 11 and the second branch element 12, respectively. As long as the resonant frequency and the impedance remain within allowable ranges for using the antenna device 1, the widths of the first and the second branch elements 11 and 12 need not be restricted.

In the above simulations of the first embodiment, the distance between the portions of the first branch element 11 and of the second branch element 12 parallel to each other has been assumed to be 2 mm. An effect of changing the above distance has been studied by the inventor of the present invention.

In a case where the above distance shown in FIG. 4A is, e.g., 4 or 6 mm based on the same conditions as of FIG. 8, no remarkable change of the resonance characteristic has been observed for a reason that the lowest resonant frequency (F2) is determined by a total length of the RF current path length and does not depend upon a location of the fold portion 19. Thus, the distance between the portions of the first antenna element 11 and the second antenna element 12 parallel to each other need not be restricted.

According to the first embodiment of the present invention described above, the antenna device 1 may be configured by selecting the length and the direction of the RF current path corresponding to each of the resonant frequencies so as to determine each of the resonant frequencies more independently.

Figure 13:
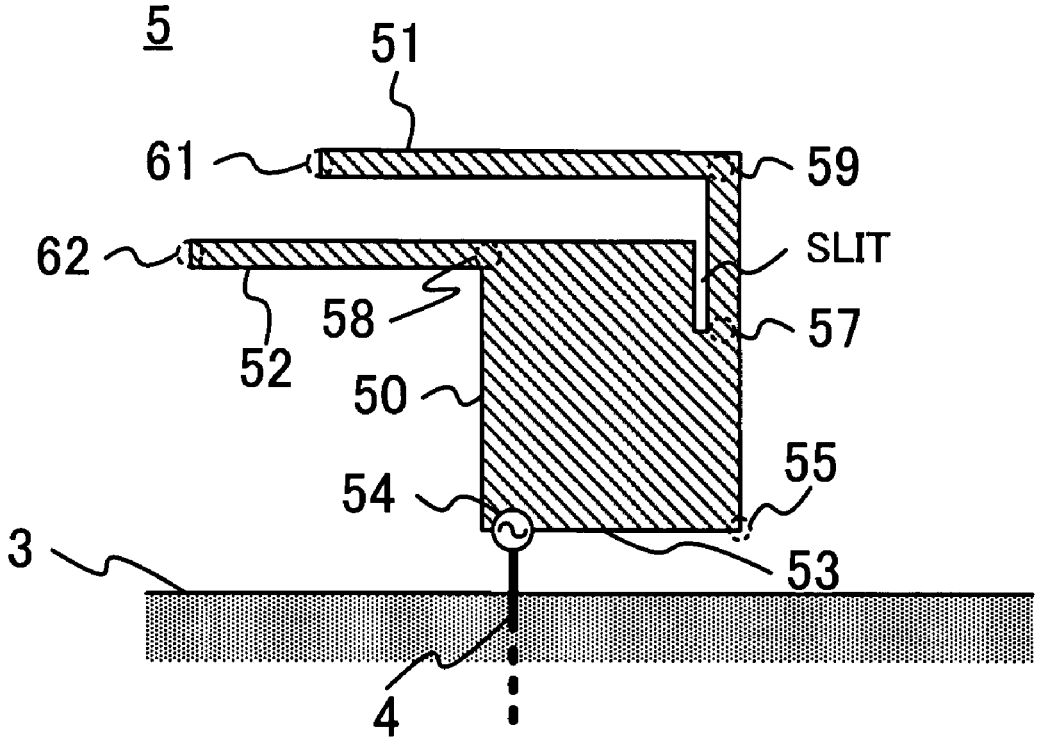
FIG. 13 is a plan view of an antenna device of a second embodiment of the present invention to show a configuration and a shape of a main portion of the antenna device of the second embodiment.

A second embodiment of the present invention will be described with reference to FIGS. 13 and 14. The antenna device 1 of the first embodiment may be modified to be an antenna device 5 of the second embodiment by changing the shape of the partial elements of the antenna device 1. Thus, the members shown in FIG. 1 of the first embodiment such as printed board 2, the ground conductor 3 and the feed line 4 will also be shown or referred to for describing the second embodiment.

The antenna device 5 includes the ground conductor 3 of the printed board 2 and an antenna element located close to the ground conductor 3. The antenna element is formed by a plurality of partial elements which will be explained later. FIG. 13 is a plan view of the antenna device 5 to show a configuration and a shape of a main portion of the antenna device 5.

The antenna device 5 has a fed partial element 50 including a portion connected to the feed line 4. The antenna device 5 has a first branch element 51 and a second branch element 52, each of which branches off from the fed partial element 50 and reaches an open end.

The fed partial element 50 is surrounded by a fringe to form an area, and the fringe includes a lower side 53 facing an upper side of the ground conductor 3. The fed partial element 50 includes, close to a lower side 53, a feed portion 54 to which the feed line 4 is connected. One of two ends of the lower side 53 which is farther to the feed portion 54 is named a far end 55. The fed partial element 50 includes a first branch portion 57 and a second branch portion 58 each near a portion of the fringe other than the lower side 53.

The first branch element 51 branches off from the fed partial element 50 at the first branch portion 57. The first branch element 51 is folded at a fold portion 59 in a leftward direction approaching the feed portion 54. The first branch element 51 may be almost parallel to the upper side of the ground conductor 3. The first branch element 51 reaches a first open end 61.

The second branch element 52 branches off from the fed partial element 50 at the second branch portion 58 in a direction close to the direction of the first branch element 51. The second branch element 52 may be almost parallel to the upper side of the ground conductor 3 as going away from the far end 55. The second branch element 52 reaches a second open end 62.

The fed partial element 50 has an inward narrow cut from the fringe (a slit) close to the first branch portion 57. As shown by comparison between FIG. 13 and FIG. 2, the antenna device 5 has a configuration and a shape which are same as the configuration and the shape of the antenna device 1 except with or without the slit.

The antenna device 5 shows a resonance characteristic which varies depending upon with or without the slit, and with reference to FIG. 14 the above characteristic of the antenna device 5 will be explained. FIG. 14 is a graph of a resonance characteristic of the antenna device 5 estimated by a simulation to be compared with the resonance characteristic of the antenna device 1 of the first embodiment. The simulation has been done under the same conditions for the antenna device 1 as of FIG. 8 (where the first branch element 11 has a length of 20 mm), plus a condition for the antenna device 5 that the slit has a depth of 5 mm (where the first branch element 51 has a length of 25 mm).

Figure 14:
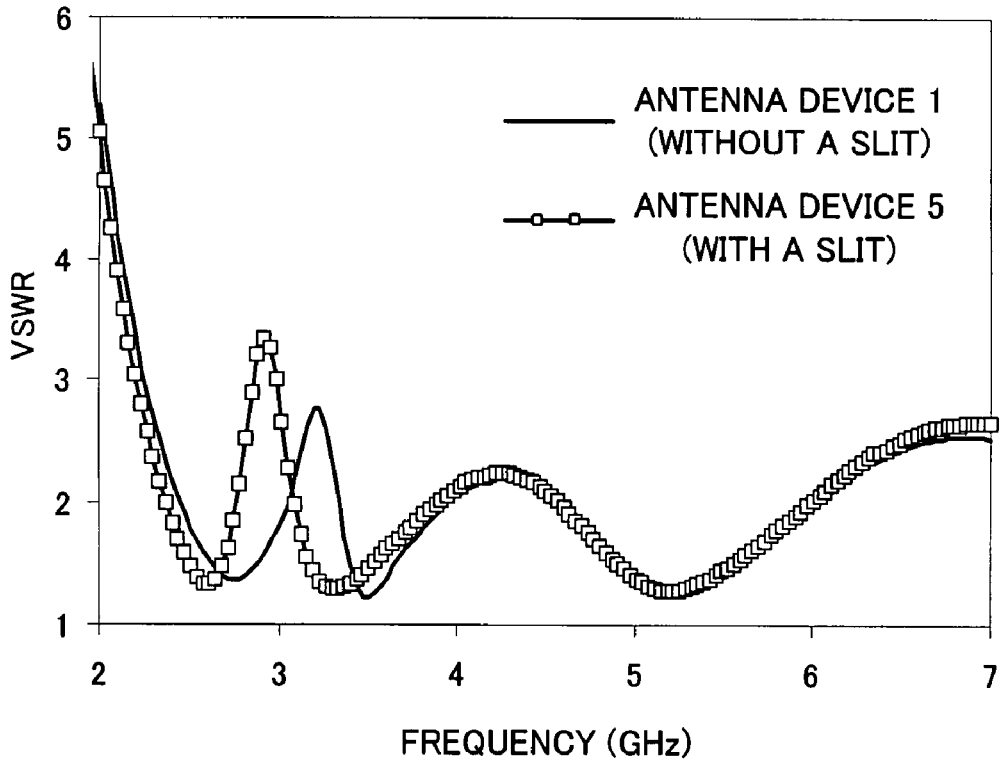
FIG. 14 is a graph of a resonance characteristic of the antenna device of the second embodiment to be compared with the resonance characteristic of the antenna device of the first embodiment.

As shown in FIG. 14, the antenna device 5 has a lowest resonant frequency affected by the slit and shifted to lower than the corresponding (lowest) resonant frequency of the antenna device 1. Why the slit causes the above shift of the lowest resonant frequency may be explained as follows. The antenna device 5 has an RF current path corresponding to the lowest resonant frequency formed from the feed portion 54, via the far end 55, the first branch portion 57 and the fold portion 59, and to the first open end 61. The first branch element 51, which is relatively narrow and likely to concentrate an RF current, shares a greater portion of the above RF current path than the first branch element 11 of the antenna device 1 does.

Meanwhile, the antenna device 5 has a highest resonant frequency which equals the highest resonant frequency of the antenna device 1. As determined by a length from the feed portion 54 to the far end 55, the highest resonant frequency is hardly affected by the slit. Thus, the depth of the slit may be selected so that the lower resonant frequencies may be selected and determined while the highest resonant frequency is kept almost constant.

The fed partial element 50 may have a slit close to the second branch portion 58. In this case, the antenna device 5 may shift the resonant frequency determined by the path length from the feed portion 54, via the second branch portion 58 and to the second open end 62 to lower than the corresponding resonant frequency of the antenna device 1. Meanwhile, the highest resonant frequency may be kept almost constant.

According to the second embodiment of the present invention described above, the antenna device 5 having a slit close to the first branch portion 57 or the second branch portion 58 may further select and determine a lower resonant frequency by selecting a depth of the slit independently of the highest resonant frequency.

A third embodiment of the present invention will be described with reference to FIG. 15. The antenna device 1 of the first embodiment may be modified to be an antenna device 6 of the third embodiment by changing the shape of the ground conductor 3 of the first embodiment into a ground conductor 7 of the third embodiment. Thus, the printed board 2 and the feed line 4 will also be shown or referred to for describing the third embodiment.

Figure 15:
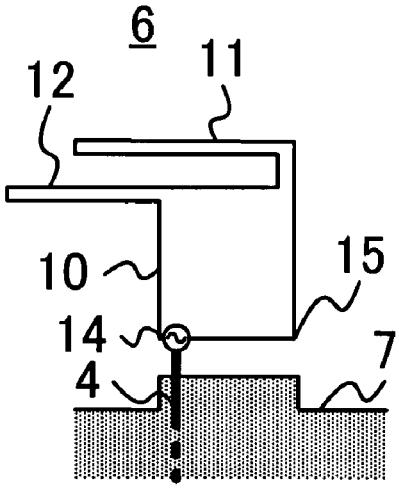
FIG. 15 is a plan view of a main portion of an antenna device of a third embodiment of the present invention.

FIG. 15 is a plan view of a main portion of the antenna device 6 to show a configuration and a shape of the antenna device 6. Each of portions of the antenna device 6 shown in FIG. 15 is given a same reference numeral as described with respect to the first embodiment, except for the ground conductor 7.

The antenna device 6 includes the above ground conductor 7 and same members as described with respect to the first embodiment, which are the fed partial element 10, the first branch element 11 and the second branch element 12. The fed partial element 10 is connected to a radio circuit which is not shown by the feed line 4 located on the ground conductor 7.

The ground conductor 7 is shaped in such a way that a portion of an upper side of the ground conductor 7 facing the fed partial element 10 projects out. Between the above portion which projects out and the fed partial element 10, there is a distance no greater than three tenths of the length from the feed portion 14 to the far end 15.

As the ground conductor 7 is shaped as shown in FIG. 15, an average distance between the first branch element 11 (or the second branch element 12) and the ground conductor 7 is greater than the distance between the first branch element 11 (or the second branch element 12) and the ground conductor 3 of the first embodiment.

As a value of electrostatic capacitance between the first branch element 11 (or the second branch element 12) and the ground conductor 7 decreases, the antenna device 6 may have impedance higher than the impedance of the antenna device 1 of the first embodiment. The antenna device 6 may determine the value of the impedance by selecting a depth of the above projection of the ground conductor 7 so as to improve impedance matching.

According to the third embodiment of the present invention described above, the antenna device 6 may further improve impedance matching by making a portion of the ground conductor 7 provided in the printed board 2 project out toward the antenna element and by selecting the depth of the above projection.

Figure 16:
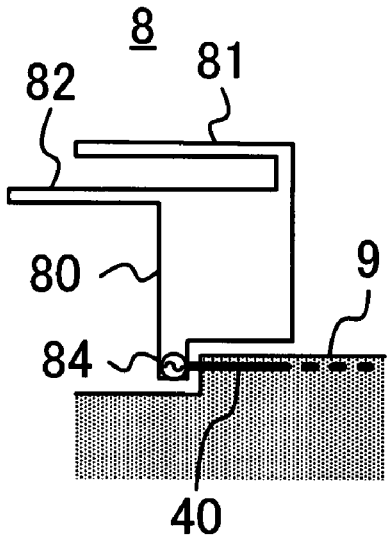
FIG. 16 is a plan view of a main portion of an antenna device of a fourth embodiment of the present invention.

A fourth embodiment of the present invention will be described with reference to FIG. 16. The antenna device 1 of the first embodiment may be modified to be an antenna device 8 of the fourth embodiment by changing the shape of the ground conductor 3 and the shape of the fed partial element 10 of the first embodiment into a ground conductor 9 and a fed partial element 80, respectively, of the fourth embodiment. FIG. 16 is a plan view of a main portion of the antenna device 8 to show a configuration and a shape of the antenna device 8.

Each of partial elements of the antenna device 8 other than the fed partial element 80 is formed by branching off from the fed partial element 80 like the first branch element 11 and the second branch element 12 of the first embodiment. The above partial elements are, however, given updated reference numerals to be a first branch element 81 and a second branch element 82.

The ground conductor 9 is shaped in such a way that a portion of an upper side of the ground conductor 9 facing the fed partial element 80 has a difference in level. The fed partial element 80 is shaped in such a way that a portion including a left end of a lower side of the fed partial element 80 facing the upper side of the ground conductor 9 projects out. The fed partial element 80 has a shape and a positional relationship with the ground conductor 9 as shown in FIG. 16, as if the fed partial element 80 faces the ground conductor 9 over, e.g., a crank-shaped gap.

In the above portion of the fed partial element 80 that projects out, located is a feed portion 84 which is connected to a not shown radio circuit by a feed line 40 located on the ground conductor 9.

As the ground conductor 9 and the fed partial element 80 are shaped and in a relative position to each other as shown in FIG. 16, the feed line 40 may be located almost parallel to the upper side of the ground conductor 9. Depending on implementation of a radio apparatus having the antenna device 9, e.g., in a case where a display device (not shown) is located in a lower area in FIG. 16, the feed line 40 may be located along a fringe of a screen of the display device. As the feed line 40 need not be located on a back side of the display device, the configuration of the antenna device 8 may contribute to downsizing of the radio apparatus.

According to the fourth embodiment of the present invention described above, the antenna device 8 may arrange a direction of the feed line 40 by arranging shapes of and a relative position between the portions of the fed partial element 80 and the ground conductor 9 facing to each other, and may contribute to downsizing of the radio apparatus including the antenna device 8.

In the descriptions of the above embodiments, each of the shapes, configurations and locations of the printed boards, ground conductors and antenna elements, or each of the values provided as the conditions of the simulations, has been given as an example and may be variously modified within a scope of the present invention, such as including a meander-shaped antenna element, adding a lumped constant element or a parasitic element, etc.

The particular hardware or software implementation of the pre-sent invention may be varied while still remaining within the scope of the present invention. It is therefore to be understood that within the scope of the appended claims and their equivalents, the invention may be practiced otherwise than as specifically described herein.

What is claimed is:

1. An antenna device usable in a radio apparatus including a printed circuit board, comprising:

a ground conductor provided in the printed circuit board;

a fed partial element shaped as an area including a feed portion near an end of a first side of the area facing a side of the ground conductor, the fed partial element including a first branch portion and a second branch portion each near a portion of a fringe of the area other than the first side, the fed partial element configured to be a fed at the feed portion;

a first branch element branching off from the first branch portion and reaching a first open end, the first branch element shaped in a manner to be folded in a direction approaching the feed portion; and a second branch element branching off from the second branch portion and reaching a second open end, the second branch element shaped in a direction close to the direction of the first branch element.

2. The antenna device of claim 1, wherein the second branch element is shaped to go away from a far end of the first side.

3. The antenna device of claim 1, wherein the first branch element is shaped almost parallel to the side of the ground conductor.

4. The antenna device of claim 1, wherein the second branch element is shaped almost parallel to the side of the ground conductor.

5. The antenna device of claim 1, wherein the ground conductor and the fed partial element are located in such a way that a distance between the side of the ground conductor and the first side of the fed partial element is almost three-tenths of a length of the first side from the feed portion to a far end of the first side.

6. The antenna device of claim 1, wherein the fed partial element is shaped to have a slit close to one of the first branch portion and the second branch portion, the slit being cut inwards from the fringe of the area.

7. The antenna device of claim 1, wherein the ground conductor and the fed partial element are shaped and in a relative position to each other in such a way that the fed partial element is configured to be fed by a feed line at the feed portion, a portion of the feed line being located almost parallel to the side of the ground conductor.

8. An antenna device usable in a radio apparatus including a printed circuit board, comprising:

a ground conductor provided in the printed circuit board;

a fed partial element shaped as an area including a feed portion near and end of a first side of the area facing a side of the ground conductor, the fed partial element including a first branch portion and a second branch portion each near a portion of a fringe of the area other than the first side, the fed partial element configured to be fed at the feed portion, the first side having a length of one-quarter wavelength of a first frequency from the feed portion to a far end of the first side;

a first branch element branching off from the first branch portion and reaching a first open end, the first branch element shaped in a manner to be folded in a direction approaching the feed portion, the first branch element configured to be put together with and RF current path formed from the feed portion, via the far end to the first branch portion to have a length of one-quarter wavelength of a second frequency; and a second branch element branching off from the second branch portion and reaching a second open end, the second branch element shaped in a direction close to the direction of the first branch element, the second branch element configured to be put together with an RF current path formed from the feed portion to the second branch portion to have a length of one-quarter wavelength of a third frequency.

9. The antenna device of claim 8, wherein the second branch element is shaped to go away from the far end of the first side.

10. The antenna device of claim 8, wherein the first branch element is shaped almost parallel to the side of the ground conductor.

11. The antenna device of claim 8, wherein the second branch element is shaped almost parallel to the side of the ground conductor.

12. The antenna device of claim 8, wherein the ground conductor and the fed partial element are located in such a way that a distance between the side of the ground conductor and the first side of the fed partial element is almost three-tenths of a length of the first side from the feed portion to a far end of the first side.

13. The antenna device of claim 8, wherein the fed partial element is shaped to have a slit close to one of the fist branch portion and the second branch portion, the slit being cut inwards from the fringe of the area.

14. The antenna device of claim 8, wherein the ground conductor and the fed partial element are shaped and in a relative position to each other in such a way that the fed partial element is configured to be fed by a feed line at the feed portion, a portion of the feed line being located almost parallel to the side of the ground conductor.

15. The antenna device of claim 8, wherein the second branch element is given a length in such a way that the third frequency values between the first frequency and the second frequency.

16. The antenna device of claim 8, wherein the first branch element is shaped almost parallel to the side of the ground conductor, and the second branch element is given a length in such a way that the third frequency values between the first frequency and the second frequency.

17. The antenna device of claim 8, wherein the second branch element is shaped almost parallel to the side of the ground conductor, and the second branch element is given a length in such a way that the third frequency values between the first frequency and the second frequency.

18. The antenna device of claim 8, wherein the ground conductor and the fed partial element are located in such a way that a distance between the side of the ground conductor and the first side of the fed partial element is almost three-tenths of a length of the first side form the feed portion to the far end of the first side, and the second branch element is given a length in such a way that the third frequency.

19. The antenna device of claim 8, wherein the fed partial element is shaped to have a slit close to one of the first branch portion and the second branch portion, the slit being cut inwards from the fringe of the area, and the second branch element is given a length in such a way that the third frequency values between the first frequency and the second frequency.

20. The antenna device of claim 8, wherein the ground conductor and the fed partial element are shaped and in a relative position to each other in such a way that the fed partial element is configured to be fed by a feed line at the feed portion, a portion of the feed line being located almost parallel to the side of the ground conductor, and the second branch element is given a length in such a way that the third frequency values between the first frequency and the second frequency.

* * * * *